US005573887A

United States Patent [19]

Genz

[11] Patent Number: 5,573,887

[45] Date of Patent: Nov. 12, 1996

[54] METHOD OF TRANSFERRING IMAGES USING AN INTERMEDIATE CARRIER

[75] Inventor: Karl Genz, Finstersee, Switzerland

[73] Assignee: Intron Ingenieur-Unternehmung AG, Dubendorf, Switzerland

[21] Appl. No.: 331,940

[22] Filed: Oct. 31, 1994

Related U.S. Application Data

[63] Continuation-in-part of Ser. No. 107,503, Aug. 17, 1993, abandoned.

[30] Foreign Application Priority Data

May 3, 1993 [EP] European Pat. Off. ..... 93107178

[51] Int. Cl.[6] ..... G03C 8/00; G03G 13/14

[52] U.S. Cl. ..... 430/199; 430/126; 430/200; 430/252; 430/292; 399/302

[58] Field of Search ..... 430/200, 201, 430/291, 124, 126, 252, 253, 292, 199; 355/199, 271, 279

[56] References Cited

U.S. PATENT DOCUMENTS

| | | | |
|---|---|---|---|
| 4,510,225 | 4/1985 | Kuehnle et al. | 430/126 |
| 5,093,689 | 3/1992 | Imaeda | 355/279 |
| 5,392,096 | 2/1995 | Deets, II | 430/126 |

*Primary Examiner*—John S. Y. Chu
*Attorney, Agent, or Firm*—Parmelee, Bollinger & Bramblett

[57] ABSTRACT

The invention relates to a method of transferring an image of a master pattern by an intermediate carrier being a laser copy of the master pattern onto a carrier, for example a plate of metal. The surface of the carrier is provided on one side with a layer of a couch or with a layer of a lacquer or with a layer of a thermoplastic or elastomeric material or with a powder coating which is dried at an increased temperature. The material forming the image penetrates under the action of heat and pressure into the layer or the powder coating thus softened which is subsequently after-baked. A weather-resistant and scratch-resistant copy of the master pattern is provided.

9 Claims, No Drawings

METHOD OF TRANSFERRING IMAGES USING AN INTERMEDIATE CARRIER

This Application is a Continuation-In-Part of my earlier application Ser. No. 08/107,503, filed Aug. 17, 1993, now abandoned.

BACKGROUND OF THE INVENTION

The invention relates to a method of transferring images from a master pattern to a surface of a carrier using an intermediate carrier, comprising: copying the image of the master pattern onto a foil or film intermediate carrier, wherein the image transferred to the intermediate carrier is formed by a material selected from the group consisting of toners and pigments; and further comprising: transferring the material forming the image on the intermediate carrier onto a treated surface of the carrier under the action of heat and pressure.

DESCRIPTION OF THE PRIOR ART

From DE-A1-41 18 922 a method of transferring images or subjects is known according to which the image positioned on a master pattern is copied on an intermediate carrier, wherein the image being transferred onto the intermediate carrier consists of a material, for example toner, and the material forming the image is transferred onto the carrier without changing its structure under heat and under the additional, simultaneous action of pressure during a predetermined period of time. By this process, it is possible to transfer images onto any kind of carrier. This process however has the disadvantage that the transferred images are not weather-resistant and scratch-resistant.

SUMMARY OF THE INVENTION

Therefore, it is an object of the present invention to overcome the above mentioned drawbacks.

It is another object of the present invention to provide a method of transferring images by which a simple and cheap transfer of images is to be provided in a weather-resistant and scratch-resistant manner.

These objects are solved by providing the surface of the carrier destined to receive the material forming the image with a layer of a couch or with a layer of a lacquer such as an unleaded and chromate-free lacquer of aqueous polyacrylates, a vinyl-copolymer resin or silicone-modified polyester or with a layer of a thermoplastic or elastomeric material or with a powder coating, and by supplying heat during the transfer of the material forming the image onto the carrier, said heat softening the layer or the powder coating for the transfer of the material forming the image and after-baking the layer or the powder coating after the transfer.

The vinylcopolymer resin may for example include polyvinylchloride or a vinylchloride-vinylidenechloride-copolymer.

The couch or lacquer is water-soluble or solvent-soluble. The couch or lacquer may be cured by heat or air.

The material forming the image penetrated by the simultaneous action of heat and pressure into the layer or the powder coating being softened by the heat, and, as a result thereof; a closed surface layer or a closed powder coating is formed after the curing or after-baking process.

The lacquer may be white, coloured or colourless and be a one-component or two-component lacquer. The couch may also be a one-component or a two-component couch. A film or foil of polypropylene laid onto the carrier is treated by heat and pressure in order to change the structure of the surface of the transferred material forming the image.

The method according to the invention timber includes the following steps: drying the layer or the powder coating at a temperature of between 90° C. and 140° C., transferring the material forming the image to the layer or the powder coating, and after-baking the layer or the powder coating at a temperature of about 160° C.

The thickness of the layer of the thermoplastic or elastomeric material may be such that a self-supporting layer is provided. Moreover, the coated layer of lacquer may be stabilised on the ground of the carrier such that the layer can be separated by water in a cold state and can be transferred onto a new or second carrier.

After the foil or film intermediate layer provided with the toner or pigment image is laid upon the surface of the couch, lacquer or powder coated surface of the carrier, the couch, lacquer or powder coated surface is subjected to a pressure within the range of from about 5 to 70N/cm$^2$ and a temperature within the range of from about 95° C. to 115° C. for a period of time within the range of from about 3 to 60 s to transfer the toner or pigment material forming the image into the layer of couch or lacquer or into the powder coating and subsequently after-baking the couch or lacquer layer or the powder coating containing the toner or pigment material forming the image at a temperature of at least about 160° C.

DETAILED DESCRIPTION OF PREFERRED EMBODIMENTS OF THE INVENTION

In the following the present invention is described with respect to the indicated examples.

Example 1

A written term provided on a photographic picture is to be transferred onto a plate of metal.

In a first step the plate of metal is provided on one side with a layer of an aqueous lacquer free of lead and chromate, based on a vinyl-copolymer resin (color) and is then dried.

In a second step the written term is copied by a laser photocopier known per se on a foil or film forming an intermediate carrier.

In a third step the foil or film provided with the written term forming toner is laid down onto the surface of the coated plate of metal. Afterwards, this arrangement is subjected during a predetermined period of time between 3 and 60 s to a pressure of 5 to 70N/cm$^2$ and a predetermined temperature between 95° C. and 115° C. in order to transfer the toner forming the written term from the film into the layer of lacquer. At the beginning of this process the layer of lacquer is softened so that the adherence of the particles of the lacquer is changed and the pores are opened, such that the toner may perpetrate into the layer of lacquer.

By this process no change of the structure and the form of the written term occurs. Because of the supplied heat the layer of lacquer is subsequently cured or after-baked, resulting in a cured, weather-resistant and scratch-resistant layer of lacquer comprising the written term.

The process described above is performed with an equipment disclosed in the above mentioned German published patent application.

The method described in said German Patent is carried out on an equipment system comprising a laser colour copier and a transfer device. The laser copier is actually wellknown and therefore not described. The transfer device is the new essential item, consisting of a heating plate and of a press plate which is hydraulically movable with respect to the heating plate. The heating plate and the press pate are essential elements for the method. Furthermore, the device comprises a hydraulic equipment in order to displace the press plate, a device for controlling heat, pressure and time, and a housing into which these elements are arranged. The heating plate and the press plate are of rectangular shape and plane-parallel to each other.

Example 2

A written term provided on a sheet of paper is transferred on a plate of metal.

In a first step the plate of metal is provided on one side with a layer of water soluble lacquer based on a silicone-modified polyester and is dried thereafter at a temperature between 90° C. and 140° C. The following steps 2 and 3 correspond to steps 1 and 2 of example 1. In a fourth step the layer of lacquer comprising the material forming the image is after-baked at a minimum temperature of 160° C.

We claim:

1. A method of transferring images from a master pattern to a surface of a carrier using an intermediate carrier, consisting essentially of:

copying the image of the master pattern onto a foil or film intermediate carrier, wherein the image transferred to the intermediate carrier is formed by a material selected from the group consisting of toners and pigments; and transferring the material forming the image on the intermediate carrier onto a treated surface of the carrier under the action of heat and pressure, characterized in that the surface of the carrier destined to receive the material forming the image is provided with a layer of a lacquer of polyvinylchloride or a vinylchloride-vinylidenechloride copolymer and that during the transfer of the material forming the image onto the carrier, heat is supplied softening the lacquer layer for the transfer of the material forming the image and after-baking the lacquer layer after the transfer.

2. A method of transferring an image from a master pattern to a surface of a carrier using an intermediate carrier, consisting essentially of:

copying the image of the master pattern onto a foil or film intermediate carrier, wherein the image copied to the intermediate carrier is formed by a material selected from the group consisting of toners and pigments; and transferring the material forming the image on the intermediate carrier onto a treated surface of the carrier under the action of heat and pressure;

characterized in that the treated surface of the carrier, destined to receive the material from the intermediate layer forming the image, is provided with a layer of a lead- and chromate-free aqueous lacquer of a polyvinylchloride or a vinylchloride-vinylidinechloride copolymer, which lacquer has been dried at a temperature of between 90° and 140°, the film or foil intermediate layer provided with the toner or pigment image is laid on the lacquered surface of the carrier, the lacquered surface is subjected to a pressure within the range of from about 5 to 70N/cm$^2$ and a temperature within the range of from about 95° to 115° C. for a period of time within the range of from about 3 to 60 seconds to transfer the toner or pigment material forming the image into the layer of lacquer and subsequently after-baking at a temperature of at least 160° C. the layer of lacquer containing the toner or pigment material forming the image.

3. A method according to claim 1, characterized in that a water-soluble or solvent-soluble lacquer is used.

4. A method according to claim 1, characterized in that an unleaded and chromate-free lacquer is used.

5. A method according to claim 1, characterized in that a film or foil of polypropylene laid onto the carrier is treated by heat and pressure in order to change the structure of the surface of the transferred material forming the image.

6. A method according to claim 1, characterized in that the lacquer layer is dried at a temperature of between 90° C. and 140° C., and that the lacquer layer is after-baked at a temperature of about 160° C.

7. A method according to claim 1, characterized in that the thickness of the lacquer layer is such that a self-supporting layer is provided.

8. A method according to claim 1, characterized in that the coated layer of lacquer is stabilized on the surface of the carrier such that the lacquer layer may be separated by water in a cold state and may be transferred to a new carrier.

9. A method according to claim 1, wherein after the foil or film intermediate layer provided with the toner or pigment image is laid upon the surface of the lacquered surface of the carrier, the lacquered surface is subjected to a pressure within the range of from about 5 to 70N/cm$^2$ and a temperature within the range of from about 95° C. to 115° for a period of time within the range of from about 3 to 60 seconds to transfer the toner or pigment material forming the image into the layer of lacquer and subsequently after-baking the lacquer layer containing the toner or pigment material forming the image at a temperature of at least about 160° C.

* * * * *